US009835373B2

(12) United States Patent
Davies et al.

(10) Patent No.: US 9,835,373 B2
(45) Date of Patent: Dec. 5, 2017

(54) INTEGRATED CASCADE PROCESS FOR VAPORIZATION AND RECOVERY OF RESIDUAL LNG IN A FLOATING TANK APPLICATION

(71) Applicant: CONOCOPHILLIPS COMPANY, Houston, TX (US)

(72) Inventors: Paul Raymond Davies, Katy, TX (US); James Lee Harris, Jr., Katy, TX (US)

(73) Assignee: ConocoPhillips Company, Houston, TX (US)

( * ) Notice: Subject to any disclaimer, the term of this patent is extended or adjusted under 35 U.S.C. 154(b) by 734 days.

(21) Appl. No.: 14/280,134

(22) Filed: May 16, 2014

(65) Prior Publication Data

US 2014/0366561 A1 Dec. 18, 2014

Related U.S. Application Data

(60) Provisional application No. 61/835,770, filed on Jun. 17, 2013.

(51) Int. Cl.
*F25J 1/00* (2006.01)
*F25J 1/02* (2006.01)

(52) U.S. Cl.
CPC ..... *F25J 1/021* (2013.01); *F25J 1/004* (2013.01); *F25J 1/0022* (2013.01); *F25J 1/0025* (2013.01); *F25J 1/0052* (2013.01); *F25J 1/0208* (2013.01); *F25J 1/0209* (2013.01); *F25J 1/0248* (2013.01); *F25J 1/0278* (2013.01); *F17C 2221/033* (2013.01); *F17C 2223/0161* (2013.01); *F17C 2227/0157* (2013.01); *F17C 2265/033* (2013.01); *F17C 2265/034* (2013.01); *F17C 2265/05* (2013.01); *F25J 2235/60* (2013.01); *F25J 2245/90* (2013.01); *F25J 2290/62* (2013.01)

(58) Field of Classification Search
CPC .. F25J 1/0022; F25J 1/025; F25J 1/004; F25J 2245/90; F25J 1/021; F25J 2270/08; F25J 1/0025; F25J 1/0208; F25J 1/0209; F17C 7/04; F17C 2265/033; F17C 2265/034; F17C 2221/0161; F17C 2227/0157; F17C 2227/0339; F17C 2227/0306; F17C 2226/03; F17C 2226/032; F17C 2226/033; F17C 2226/036; F17C 2226/037
See application file for complete search history.

(56) References Cited

U.S. PATENT DOCUMENTS 3,374,638 A * 3/1968 Basile ..... F17C 13/004 62/240
5,359,856 A 11/1994 Rhoades et al.
(Continued)

OTHER PUBLICATIONS

International Search Report. PCT/2014/038446, dated Sep. 8, 2014.

*Primary Examiner* — Keith Raymond
(74) *Attorney, Agent, or Firm* — ConocoPhillips Company

(57) ABSTRACT

Methods and systems for vaporizing and recovering LNG are provided. One method includes: a) heating at least a portion of the LNG to provide a boil-off gas stream and a liquid quench stream; b) routing the boil-off gas stream and the liquid quench stream to a quench system, wherein the quench system cools the boil-off gas stream to provide a quenched stream; and c) compressing the quenched stream to provide a compressed quenched stream.

4 Claims, 3 Drawing Sheets

(56) References Cited

U.S. PATENT DOCUMENTS

| | | | | |
|---|---|---|---|---|
| 2005/0126220 | A1* | 6/2005 | Ward | F17C 9/02 62/625 |
| 2007/0095077 | A1 | 5/2007 | Hsu | |
| 2007/0125122 | A1* | 6/2007 | Mak | F17C 3/00 62/620 |
| 2012/0118007 | A1* | 5/2012 | Qualls | F25J 1/0022 62/611 |

* cited by examiner

INTEGRATED CASCADE PROCESS FOR VAPORIZATION AND RECOVERY OF RESIDUAL LNG IN A FLOATING TANK APPLICATION

CROSS-REFERENCE TO RELATED APPLICATIONS

This application is a non-provisional application which claims benefit under 35 USC §119(e) to U.S. Provisional Application Ser. No. 61/835,770 filed Jun. 17, 2013, entitled "INTEGRATED CASCADE PROCESS FOR VAPORIZATION AND RECOVERY OF RESIDUAL LNG IN A FLOATING TANK APPLICATION," which is incorporated herein in its entirety.

FIELD OF THE INVENTION

The present invention relates generally to liquefaction of natural gas and, more particularly, to vaporizing and recovering liquefied natural gas in an offshore liquefaction facility.

BACKGROUND OF THE INVENTION

Natural gas is an important resource widely used as energy source or as industrial feedstock used in, for example, manufacture of plastics. Comprising primarily of methane, natural gas is a mixture of naturally occurring hydrocarbon gases and is typically found in deep underground natural rock formations or other hydrocarbon reservoirs. Other components of natural gas include, but are not limited to, ethane, propane, carbon dioxide, nitrogen, and hydrogen sulfide.

Typically, natural gas is transported from source to consumers through pipelines that physically connect a reservoir to a market. Because natural gas is sometimes found in remote areas devoid of necessary infrastructure (i.e., pipelines), alternative methods for transporting natural gas must be used. This situation commonly arises when the source of natural gas and the market are separated by great distances, for example a large body of water. Bringing this natural gas from remote areas to market can have significant commercial value if the cost of transporting natural gas is minimized.

One alternative method of transporting natural gas involves converting natural gas into a liquefied form through a liquefaction process. Because natural gas exists in vapor phase under standard atmospheric conditions, it must be subjected to certain thermodynamic processes in order to be liquefied to produce liquefied natural gas (LNG). In its liquefied form, natural gas has a specific volume that is significantly lower than its specific volume in its vapor form. Thus, the liquefaction process greatly increases the ease of transporting and storing natural gas, particularly in cases where pipelines are not available. For example, ocean liners carrying LNG tanks can effectively link a natural gas source with a distant market when the source and market are separated by large bodies of water.

Converting natural gas to its liquefied form can have other economic benefits. For example, storing LNG can help balance out periodic fluctuations in natural gas supply and demand. In particular, LNG can be more easily "stockpiled" for later use when natural gas demand is low and/or supply is high. As a result, future demand peaks can be met with LNG from storage, which can be vaporized as demand requires.

In order to store and transport natural gas in the liquid state, the natural gas is typically cooled to −160° C. at near-atmospheric vapor pressure. Liquefaction of natural gas can be achieved by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems).

There are growing efforts to develop floating liquefied natural gas (FLNG) technologies that would enable operations of water-based LNG processing facilities. Such a facility could float above an offshore natural gas field, where it can produce, liquefy, store and transfer LNG at sea before shipping the LNG directly to markets.

Various aspects of the floating facility will be subjected to inspection (e.g., checking for inner tank leakage, effectiveness of insulation, etc.) and/or maintenance, which may require physical entry into FLNG LNG storage tanks. Before physical entry is possible, LNG cargo stored in the storage tanks need to be vaporized and recovered after inspection and/or maintenance. While conventional methods for vaporizing and evacuating LNG from LNG storage tanks exist, there may be additional technical challenges to removing residual LNG from FLNG LNG storage tanks due to limited space constraints. Moreover, some conventional methods of LNG do not recover vaporized LNG.

BRIEF SUMMARY OF THE DISCLOSURE

The present invention relates generally to liquefaction of natural gas and, in particular, to vaporizing and recovering liquefied natural gas in an offshore liquefaction facility.

One example of a method for vaporizing liquefied natural gas (LNG) produced from a main liquefaction process and stored in an LNG storage tank comprises: a) heating at least a portion of the LNG to provide a boil-off gas stream and a liquid quench stream; b) routing the boil-off gas stream and the liquid quench stream to a quench system, wherein the quench system cools the boil-off gas stream to provide a quenched stream; and c) compressing the quenched stream to provide a compressed quenched stream.

Another example of a method for vaporizing liquefied natural gas (LNG) produced from a main liquefaction process and stored in an LNG storage tank comprises: a) heating via a warm predominantly methane stream at least a portion of the LNG to provide a boil-off gas stream and a liquid quench stream; b) routing the boil-off gas stream and the liquid quench stream to a quench system, wherein the quench system cools the boil-off gas stream to provide a quenched stream; and c) compressing the quenched stream to provide a compressed quenched stream.

An example of a system for vaporizing liquefied natural gas (LNG) comprises: at least one LNG storage tank for storing cryogenic materials; a quench system located downstream of the at least one LNG storage tank for cooling boil-off gas produced from the at least one LNG storage tank, the quench system comprising at least two conduits, wherein a first conduit allows transport of boil-off gas from the at least one LNG storage tank to the quench system and a second conduit allows transport of liquid quench stream from the at least one LNG storage tank to the quench system; and a compressor located downstream of the quench system, wherein the compressor is configured to compress a stream exiting from the quench system.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Figure 1:
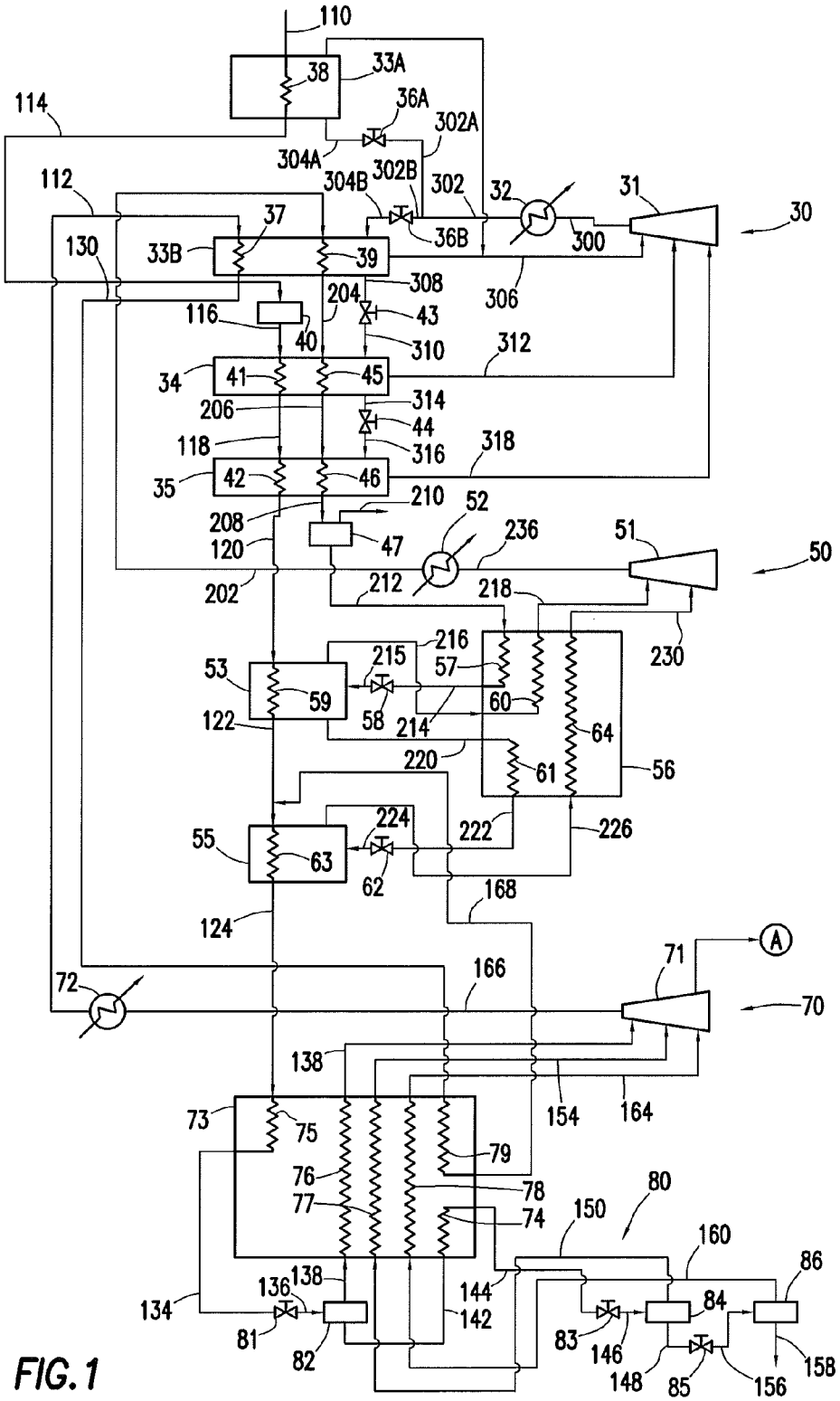
FIG. 1 is a simplified flow diagram of a cascade refrigeration process for LNG production compatible with a vaporization and recovery system according to one or more embodiments.

The present invention provides systems and methods for vaporizing and recovering residual LNG found in LNG storage tanks LNG storage tanks are specialized insulated cryogenic containers used to store LNG. While LNG storage tanks are typically installed in or above ground, they may also be installed on offshore LNG vessel. An LNG storage tank installed on an offshore vessel will be referred herein as "FLNG LNG storage tank."

While LNG is generally considered safe (e.g., LNG is not explosive as a liquid), periodic inspection of LNG facilities is recommended and/or required. Safety inspection of LNG storage tanks is often carried out within 5 years after date of built or after the crediting date of a previous inspection in accordance with rules or requirements of a governing authority (e.g., Classification Society). Before these inspections can take place, LNG stored in the LNG storage tank must be evacuated. Typically, last few feet of LNG residing from the heel of the storage tanks ("residual LNG") are most difficult to vaporize and evacuate. While the LNG storage tank undergoing inspection and/or maintenance should be in a gas-free or substantially gas-free condition, costs associated with inspection/maintenance may be minimized if other LNG storage tanks remain under operation. This may be achieved by segregating the evacuated LNG storage tank from cargo production/offloading lines. Once the LNG storage tanks are de-commissioned, inspection and/or maintenance of the LNG storage tanks may be performed. The present invention can significantly minimize time required to vaporize and evacuate LNG prior to inspection and/or maintenance. Moreover, LNG vaporized from the LNG storage tank may be recovered to a main liquefaction process (i.e., LNG producing process). This process of vaporization and recovery may reduce flaring. Other advantages will be apparent from the disclosure herein.

The present invention can be implemented or otherwise integrated with an LNG facility used to cool natural gas to its liquefaction temperature to produce liquefied natural gas. The LNG facility generally employs one or more refrigerants to extract heat from the natural gas and reject to the environment. Numerous configurations of LNG systems exist and the present invention may be implemented in many different types of LNG systems. The present invention may be integrated with one or more existing LNG processes (including cascade processes) and may be compatible with future LNG processes (including FLNG processes and facilities), which reduces capital equipment required. As used herein, "vaporization and recovery system" refer to those features and equipment primarily involved in the vaporization and recovery of the residual LNG.

In one embodiment, the present invention may be implemented in a mixed refrigerant LNG system. Examples of mixed refrigerant processes can include, but are not limited to, a single refrigeration system using a mixed refrigerant, a propane pre-cooled mixed refrigerant system, and a dual mixed refrigerant system.

In another embodiment, the present invention may be implemented in a cascade LNG system employing a cascade-type refrigeration process using one or more predominately pure component refrigerants. The refrigerants utilized in cascade-type refrigeration processes can have successively lower boiling points in order to facilitate heat removal from the natural gas stream being liquefied. Additionally, cascade-type refrigeration processes can include some level of heat integration. For example, a cascade-type refrigeration process can cool one or more refrigerants having a higher volatility through indirect heat exchange with one or more refrigerants having a lower volatility. In addition to cooling the natural gas stream through indirect heat exchange with one or more refrigerants, cascade and mixed-refrigerant LNG systems can employ one or more expansion cooling stages to simultaneously cool the LNG while reducing its pressure.

Cascade LNG Process

In one embodiment, the LNG process may employ a cascade-type refrigeration process that uses a plurality of multi-stage cooling cycles, each employing a different refrigerant composition, to sequentially cool the natural gas stream to lower and lower temperatures. For example, a first refrigerant may be used to cool a first refrigeration cycle. A second refrigerant may be used to cool a second refrigeration cycle. A third refrigerant may be used to cool a third refrigeration cycle. Each refrigeration cycle may consider a closed cycle or an open cycle. The terms "first", "second", and "third" refer to the relative position of a refrigeration cycle. For example, the first refrigeration cycle is positioned just upstream of the second refrigeration cycle while the second refrigeration cycle is positioned upstream of the third refrigeration cycle and so forth. While at least one reference to a cascade LNG process comprising 3 different refrigerants in 3 separate refrigeration cycles is made, this is not intended to be limiting. It is recognized that a cascade LNG process involving any number of refrigerants and/or refrigeration cycles may be compatible with one or more embodiments of the present invention. Other variations to the cascade LNG process may also be contemplated. In another embodiment, the mixed-reflux heavies removal system of the present invention may be utilized in non-cascade LNG processes. One example of a non-cascade LNG process involves a mixed refrigerant LNG process that employs a combination of two or more refrigerants to cool the natural gas stream in at least one cooling cycle.

Figure 2A:
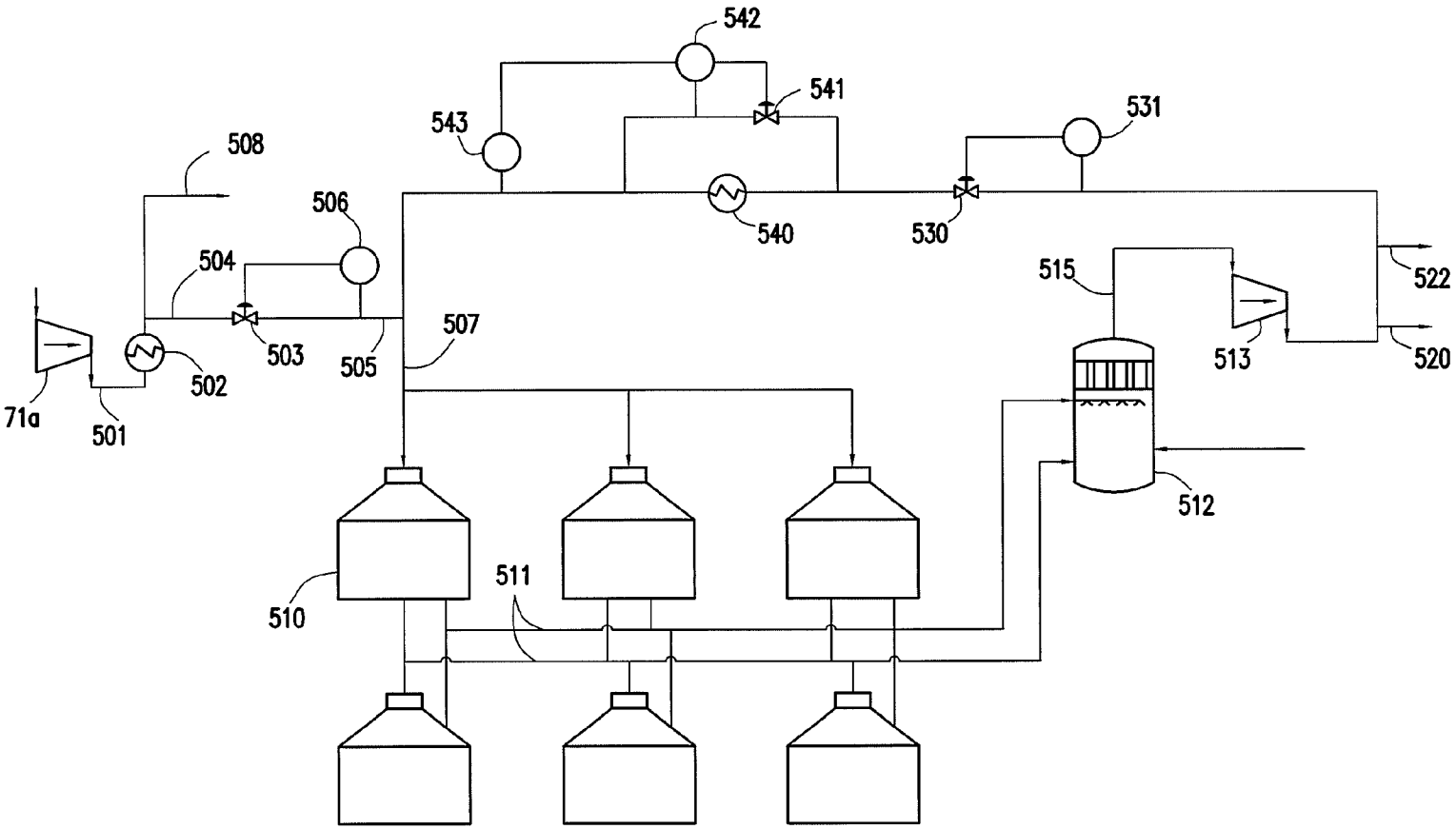
FIG. 2A is a flow diagram of a vaporization and recovery system according to one or more embodiments operating in an open mode.
Figure 2B:
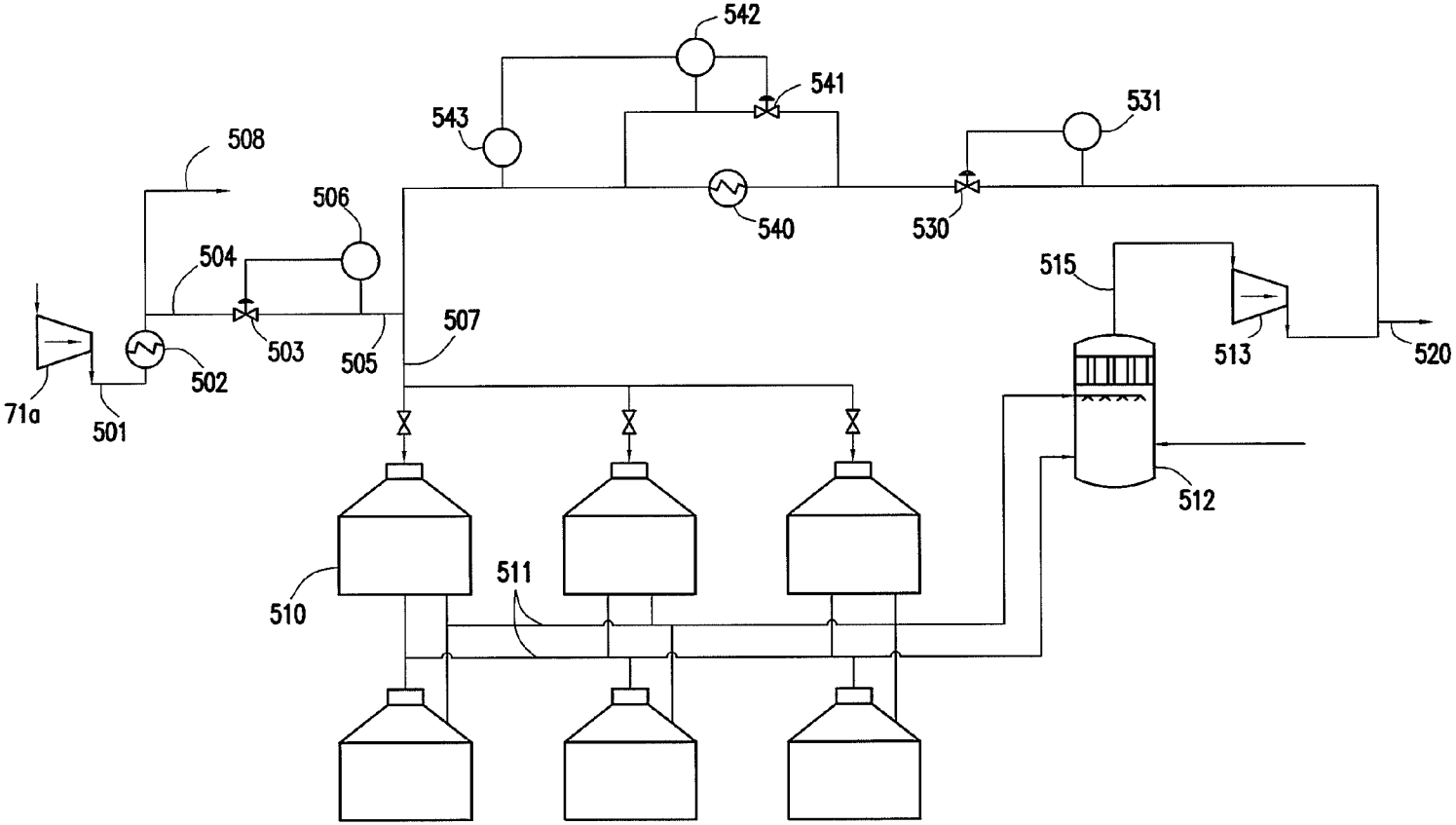
FIG. 2B is a flow diagram of a vaporization and recovery system according to one or more embodiments operating in a closed mode.

Referring first to FIG. 1, an example cascade LNG facility in accordance with the concept described herein is illustrated. The LNG facility depicted in FIG. 1 generally comprises a propane refrigeration cycle 30, an ethylene refrigeration cycle 50, and a methane refrigeration cycle 70 with an expansion section 80. FIGS. 2A and 2B illustrate embodiments of vaporization and recovery system that may be integrated with LNG producing facility (e.g., facility shown in FIG. 1). More specifically, FIG. 2A illustrates an open operation mode ("open mode") in which vaporization and recovery of residual LNG is achieved while the vaporization and recovery system is open to the main liquefaction process (e.g., process shown in FIG. 1). FIG. 2B illustrates a closed operation mode ("closed mode") in which vaporization and recovery of residual LNG is achieved while the vaporization and recovery system is closed to the main liquefaction process. Those skilled in the art will recognize that FIGS. 1-2B are schematics only and, therefore, many items of equipment that would be needed in a commercial plant for successful operation have been omitted for sake of clarity. Such items might include, for example, compressor controls, flow and level measurements and corresponding controllers, temperature and pressure controls, pumps, motors, filters, additional heat exchangers, valves, and the like. These items would be provided in accordance with standard engineering practice.

While "propane," "ethylene," and "methane" are used to refer to respective first, second, and third refrigerants, it should be understood that the embodiment illustrated in FIG. 1 and described herein can apply to any combination of suitable refrigerants. The main components of propane refrigeration cycle 30 include a propane compressor 31, a propane cooler/condenser 32, high-stage propane chillers 33A and 33B, an intermediate-stage propane chiller 34, and a low-stage propane chiller 35. The main components of ethylene refrigeration cycle 50 include an ethylene compressor 51, an ethylene cooler 52, a high-stage ethylene chiller 53, a low-stage ethylene chiller/condenser 55, and an ethylene economizer 56. The main components of methane refrigeration cycle 70 include a methane compressor 71, a methane cooler 72, and a methane economizer 73. The main components of expansion section 80 include a high-stage methane expansion valve and/or expander 81, a high-stage methane flash drum 82, an intermediate-stage methane expansion valve and/or expander 83, an intermediate-stage methane flash drum 84, a low-stage methane expansion valve and/or expander 85, and a low-stage methane flash drum 86.

The operation of the LNG facility illustrated in FIG. 1 will now be described in more detail, beginning with propane refrigeration cycle 30. Propane is compressed in multi-stage (e.g., three-stage) propane compressor 31 driven by, for example, a gas turbine driver (not illustrated). The stages of compression may exist in a single unit or two or more separate units mechanically coupled to a single driver. Upon compression, the propane is passed through conduit 300 to propane cooler 32 where it is cooled and liquefied through indirect heat exchange with an external fluid (e.g., air or water). A portion of the stream from propane cooler 32 can then be passed through conduits 302 and 302A to a pressure reduction means, illustrated as expansion valve 36A, wherein the pressure of the liquefied propane is reduced, thereby evaporating or flashing a portion thereof. The resulting two-phase stream then flows through conduit 304*a* into high-stage propane chiller 33A where it can cool the natural gas stream 110 in indirect heat exchange means 38. High stage propane chiller 33A uses the flashed propane refrigerant to cool the incoming natural gas stream in conduit 110. Another portion of the stream from propane cooler 32 is routed through conduit 302B to another pressure reduction means, illustrated as expansion valve 36B, wherein the pressure of the liquefied propane is reduced in stream 304B.

The cooled natural gas stream from high-stage propane chiller 33A flows through conduit 114 to a separation vessel, wherein water and in some cases a portion of propane and/or heavier components are removed, typically followed by a treatment system 40, in cases where not already completed in upstream processing, wherein moisture, mercury and mercury compounds, particulates, and other contaminants are removed to create a treated stream. The stream exits the treatment system 40 through conduit 116. The stream 116 then enters intermediate-stage propane chiller 34, wherein the stream is cooled in indirect heat exchange means 41 via indirect heat exchange with a propane refrigerant stream. The resulting cooled stream in conduit 118 is routed to low-stage propane chiller 35, wherein the stream can be further cooled through indirect heat exchange means 42. The resultant cooled stream can then exit low-stage propane chiller 35 through conduit 120. Subsequently, the cooled stream in conduit 120 can be routed to high-stage ethylene chiller 53.

A vaporized propane refrigerant stream exiting high-stage propane chillers 33A and 33B is returned to the high-stage inlet port of propane compressor 31 through conduit 306. An unvaporized propane refrigerant stream exits the high-stage propane chiller 33B via conduit 308 and is flashed via a pressure reduction means, illustrated here in FIG. 1 as expansion valve 43. The liquid propane refrigerant in high-stage propane chiller 33A provides refrigeration duty for the natural gas stream 110. Two-phase refrigerant stream can enter the intermediate-stage propane chiller 34 through conduit 310, thereby providing coolant for the natural gas stream (in conduit 116) and stream entering intermediate-stage propane chiller 34 through conduit 204. The vaporized portion of the propane refrigerant exits intermediate-stage propane chiller 34 through conduit 312 and enters the intermediate-stage inlet port of propane compressor 31. The liquefied portion of the propane refrigerant exits intermediate-stage propane chiller 34 through conduit 314 and is passed through a pressure-reduction means, illustrated here as expansion valve 44, whereupon the pressure of the liquefied propane refrigerant is reduced to flash or vaporize a portion thereof. The resulting vapor-liquid refrigerant stream can then be routed to low-stage propane chiller 35 through conduit 316 and where the refrigerant stream can cool the methane-rich stream and an ethylene refrigerant stream entering low-stage propane chiller 35 through conduits 118 and 206, respectively. The vaporized propane refrigerant stream then exits low-stage propane chiller 35 and is routed to the low-stage inlet port of propane compressor 31 through conduit 318 wherein it is compressed and recycled as previously described.

Still referring to FIG. 1, a stream of ethylene refrigerant in conduit 202 enters high-stage propane chiller 33B, wherein the ethylene stream is cooled through indirect heat exchange means 39. The resulting cooled ethylene stream can then be routed in conduit 204 from high-stage propane chiller 33B to intermediate-stage propane chiller 34. Upon entering intermediate-stage propane chiller 34, the ethylene refrigerant stream can be further cooled through indirect heat exchange means 45 in intermediate-stage propane chiller 34. The resulting cooled ethylene stream can then exit intermediate-stage propane chiller 34 and can be routed through conduit 206 to enter low-stage propane chiller 35. In low-stage propane chiller 35, the ethylene refrigerant stream can be at least partially condensed, or condensed in its entirety, through indirect heat exchange means 46. The resulting stream exits low-stage propane chiller 35 through conduit 208 and can subsequently be routed to a separation vessel 47, wherein a vapor portion of the stream, if present, can be removed through conduit 210, while a liquid portion of the ethylene refrigerant stream can exit separator 47 through conduit 212. The liquid portion of the ethylene refrigerant stream exiting separator 47 can have a representative temperature and pressure of about −24° F. (about −31° C.) and about 285 psia (about 1,965 kPa).

Turning now to the ethylene refrigeration cycle 50 in FIG. 1, liquefied ethylene refrigerant stream in conduit 212 can enter an ethylene economizer 56, wherein the stream can be further cooled by an indirect heat exchange means 57. The resulting cooled liquid ethylene stream in conduit 214 can then be routed through a pressure reduction means, illustrated here as expansion valve 58, whereupon the pressure of the cooled predominantly liquid ethylene stream is reduced to thereby flash or vaporize a portion thereof. The cooled, two-phase stream in conduit 215 can then enter high-stage ethylene chiller 53. In high-stage ethylene chiller 53, at least a portion of the ethylene refrigerant stream can vaporize to further cool the stream in conduit 120 entering an indirect heat exchange means 59. The vaporized and remaining liquefied ethylene refrigerant exits high-stage ethylene chiller 53 through conduits 216 and 220, respectively. The vaporized ethylene refrigerant in conduit 216 can re-enter ethylene economizer 56, wherein the stream can be warmed through an indirect heat exchange means 60 prior to entering the high-stage inlet port of ethylene compressor 51 through conduit 218. Ethylene is compressed in multi-stage (e.g., three-stage) ethylene compressor 51 driven by, for example, a gas turbine driver (not illustrated). The stages of compression may exist in a single unit or two or more separate units mechanically coupled to a single driver.

The cooled stream in conduit 120 exiting low-stage propane chiller 35 can be routed to high-stage ethylene chiller 53, where it is cooled via indirect heat exchange means 59 of high-stage ethylene chiller 53. The remaining liquefied ethylene refrigerant exiting high-stage ethylene chiller 53 in conduit 220 can re-enter ethylene economizer 56 and undergo further sub-cooling by an indirect heat exchange means 61 in ethylene economizer 56. The resulting sub-cooled refrigerant stream exits ethylene economizer 56 through conduit 222 and subsequently passes a pressure reduction means, illustrated here as expansion valve 62, whereupon the pressure of the refrigerant stream is reduced to vaporize or flash a portion thereof. The resulting, cooled two-phase stream in conduit 224 enters low-stage ethylene chiller/condenser 55.

A portion of the cooled natural gas stream exiting high-stage ethylene chiller 53 can be routed through conduit 122 to enter indirect heat exchange means 63 of low-stage ethylene chiller/condenser 55. In the low-stage ethylene chiller/condenser 55, cooled stream can be at least partially condensed and, often, subcooled through indirect heat exchange with the ethylene refrigerant entering low-stage ethylene chiller/condenser 55 through conduit 224. The vaporized ethylene refrigerant exits low-stage ethylene chiller/condenser 55 through conduit 226, which then enters ethylene economizer 56. In the ethylene economizer 56, vaporized ethylene refrigerant stream 226 can be warmed through an indirect heat exchange means 64 prior to being fed into the low-stage inlet port of ethylene compressor 51 through conduit 230. As shown in FIG. 1, a stream of compressed ethylene refrigerant exits ethylene compressor 51 through conduit 236 and subsequently enters ethylene cooler 52, wherein the compressed ethylene stream can be cooled through indirect heat exchange with an external fluid (e.g., water or air). The resulting cooled ethylene stream is introduced through conduit 202 into high-stage propane chiller 33B for additional cooling as previously described.

The condensed and, often, subcooled liquid natural gas stream exiting low-stage ethylene chiller/condenser 55 in conduit 124 can also be referred to as a "pressurized LNG-bearing stream." This pressurized LNG-bearing stream exits low-stage ethylene chiller/condenser 55 through conduit 124 prior to entering main methane economizer 73. In the main methane economizer 73, methane-rich stream in conduit 124 can be further cooled in an indirect heat exchange means 75 through indirect heat exchange with one or more methane refrigerant streams (e.g., 76, 77, 78). The cooled, pressurized LNG-bearing stream exits main methane economizer 73 through conduit 134 and routes to expansion section 80 of methane refrigeration cycle 70. In the expansion section 80, the pressurized LNG-bearing stream first passes through high-stage methane expansion valve or expander 81, whereupon the pressure of this stream is reduced to vaporize or flash a portion thereof. The resulting two-phase methane-rich stream in conduit 136 can then enter into high-stage methane flash drum 82, whereupon the vapor and liquid portions of the reduced-pressure stream can be separated. The vapor portion of the reduced-pressure stream (also called the high-stage flash gas) exits high-stage methane flash drum 82 through conduit 138 to then enter into main methane economizer 73, wherein at least a portion of the high-stage flash gas can be heated through indirect heat exchange means 76 of main methane economizer 73. The resulting warmed vapor stream exits main methane economizer 73 through conduit 138 and is then routed to the high-stage inlet port of methane compressor 71, as shown in FIG. 1.

The liquid portion of the reduced-pressure stream exits high-stage methane flash drum 82 through conduit 142 to then re-enter main methane economizer 73, wherein the liquid stream can be cooled through indirect heat exchange means 74 of main methane economizer 73. The resulting cooled stream exits main methane economizer 73 through conduit 144 and then routed to a second expansion stage, illustrated here as intermediate-stage expansion valve 83 and/or expander. Intermediate-stage expansion valve 83 further reduces the pressure of the cooled methane stream which reduces the stream's temperature by vaporizing or flashing a portion thereof. The resulting two-phase methane-rich stream in conduit 146 can then enter intermediate-stage methane flash drum 84, wherein the liquid and vapor portions of this stream can be separated and exits the intermediate-stage flash drum 84 through conduits 148 and 150, respectively. The vapor portion (also called the intermediate-stage flash gas) in conduit 150 can re-enter methane economizer 73, wherein the vapor portion can be heated through an indirect heat exchange means 77 of main methane economizer 73. The resulting warmed stream can then be routed through conduit 154 to the intermediate-stage inlet port of methane compressor 71, as shown in FIG. 1.

The liquid stream exiting intermediate-stage methane flash drum 84 through conduit 148 can then pass through a low-stage expansion valve 85 and/or expander, whereupon the pressure of the liquefied methane-rich stream can be further reduced to vaporize or flash a portion thereof. The resulting cooled, two-phase stream in conduit 156 can then enter low-stage methane flash drum 86, wherein the vapor and liquid phases are separated. The liquid stream exiting low-stage methane flash drum 86 through conduit 158 can comprise the liquefied natural gas (LNG) product at near atmospheric pressure. This LNG product can be routed downstream for subsequent storage, transportation, and/or use.

A vapor stream exiting low-stage methane flash drum (also called the low-stage methane flash gas) in conduit 160 can be routed to methane economizer 73, wherein the low-stage methane flash gas can be warmed through an indirect heat exchange means 78 of main methane economizer 73. The resulting stream can exit methane economizer 73 through conduit 164, whereafter the stream can be routed to the low-stage inlet port of methane compressor 71.

The methane compressor 71 can comprise one or more compression stages. In one embodiment, methane compressor 71 comprises three compression stages in a single module. In another embodiment, one or more of the compression modules can be separate but mechanically coupled to a common driver. Generally, one or more intercoolers (not shown) can be provided between subsequent compression stages.

As shown in FIG. 1, a compressed methane refrigerant stream exiting methane compressor 71 can be discharged into conduit 166. The compressed methane refrigerant can be routed to methane cooler 72, whereafter the stream can be cooled through indirect heat exchange with an external fluid (e.g., air or water) in methane cooler 72. The resulting cooled methane refrigerant stream exits methane cooler 72 through conduit 112 and is directed to and further cooled in propane refrigeration cycle 30. Upon cooling in the propane refrigeration cycle 30 through heat exchanger means 37, the methane refrigerant stream can be discharged into conduit 130 and subsequently routed to main methane economizer 73, wherein the stream can be further cooled through indirect heat exchange means 79. The resulting sub-cooled stream exits main methane economizer 73 through conduit 168 and then combined with stream in conduit 122 exiting high-stage ethylene chiller 53 prior to entering low-stage ethylene chiller/condenser 55, as previously discussed.

The liquefaction process described herein may incorporate one of several types of cooling means including, but not limited to, (a) indirect heat exchange, (b) vaporization, and (c) expansion or pressure reduction. Indirect heat exchange, as used herein, refers to a process wherein a cooler stream cools the substance to be cooled without actual physical contact between the cooler stream and the substance to be cooled. Specific examples of indirect heat exchange means include heat exchange undergone in a shell-and-tube heat exchanger, a core-in-shell heat exchanger, and a brazed aluminum plate-fin heat exchanger. The specific physical state of the refrigerant and substance to be cooled can vary depending on demands of the refrigeration system and type of heat exchanger chosen.

Expansion or pressure reduction cooling refers to cooling which occurs when the pressure of a gas, liquid or a two-phase system is decreased by passing through a pressure reduction means. In some embodiments, expansion means may be a Joule-Thomson expansion valve. In other embodiments, the expansion means may be either a hydraulic or gas expander. Because expanders recover work energy from the expansion process, lower process stream temperatures are possible upon expansion.

Vaporization and Recovery of Residual LNG

Vaporization and recovery of residual LNG may begin by routing methane from the main liquefaction process (illustrated in FIG. 1) via conduit A to a vaporization and recovery system (illustrated in FIGS. 2A and 2B). While FIGS. 2A and 2B represent different modes of operation, main components of both modes are identical. Thus, in some embodiments, a single vaporization and recovery system can operate in both open and closed mode without additional equipment. For clarity, reference numbers are used consistently for similar or same elements in the figures.

Referring to FIG. 2A, methane is taken from a methane compressor discharge in conduit 501 and passed through a methane compressor intercooler. In the illustrated embodiment, the compressor 71 is a multi-stage compressor featuring one or more compressor intercoolers. In the embodiment shown in FIG. 2A, methane is taken from a low-stage methane compressor 71*a* and to the low-stage methane compressor intercooler 502. Methane exiting the low-stage methane compressor intercooler 502 can then be introduced into the vaporization and recovery system. In some embodiments, multiple boil-off gas (BOG) compressors 513 may be present. These compressors have capacity designed to handle LNG vaporization from standing tanks and tanks being filled. In some embodiments, capacity also exists to handle ship-loading BOG from a transport carrier tanker being filled. The ship-loading capacity often sets the sizing of the BOG compressors 513. For example, if tank inspection is done when not handling ship-loading BOG vapors, excess capacity exists in the BOG compressors 513 that can be utilized to handle the re-circulated LNG vapors. In another embodiment, additional capacity can be designed into the BOG compressors 513 to handle the recirculation gas.

The introduction of methane into the vaporization and recovery system is controlled by a flow control valve 503 which regulates flow of methane via conduit 504 via a feedback loop 506. The methane in conduit 505 is at approximately 2 to 6 barg and 30 to 50° C. and subsequently injected through a header 507 that terminates below liquid level at bottom of the LNG storage tank 510. This hot methane gas evaporates the LNG while warming up the LNG storage tank 510. The resultant vaporized natural gas is routed via conduit 511 to a BOG compressor suction drum 512 and eventually to a BOG compressor 513. When connected to an FLNG vessel, boil-off gas from the vessel can be routed to the BOG compressor suction drum 512 for quenching. A portion of the vaporized natural gas can be added back into the main liquefaction process by injecting the gas into the low-stage methane compressor suction via conduit 520. A portion of the vaporized natural gas can also be flared as necessary as via conduit 522 depending on, for example, the capacity of the BOG compressors 513. The vaporization and recovery system is integrated into the main liquefaction process which, in turn, minimizes flaring of the boil-off gas.

FIG. 2B illustrates the vaporization and recovery system operating in closed mode. This mode may be useful during times when the main liquefaction process may not be available. During closed mode operation, discharge gas taken from the BOG compressor is routed to a gas heater. In some embodiments, the gas heater may be (hard piped with valves or drop out spools. This mode requires LNG in one of the other storage tanks to be used in order to generate BOG to dry out the tank being prepared for maintenance.

Referring to FIG. 2B, BOG is routed via conduit 515 to the BOG compressors 513 whereupon it is compressed. A portion of the resulting compressed BOG may be routed to the low-stage methane compressor via conduit 520 or flared if the low-stage compress is not available. Remaining portion of the compressed BOG is routed to a backup water heater 540. Flow control valve 530 regulates flow of the compressed BOG to the backup water heater 650. When the vaporization and recovery system is operating in the open mode (FIG. 2A), the flow control valve 530 is closed. When the vaporization and recovery system is operating in the closed mode (FIG. 2B), the flow control valve 530 is at least partially open. Flow control valve 541 regulates flow of gas stream to flow control unit 542 and temperature control unit 543.

Example 1

Dynamic simulations were developed to model the time required to complete a heating vaporization cycle in both open mode and closed mode operations. The simulations were based on a design that includes 4 BOG compressors producing around 38-40 tons per hour depending on exact composition of BOG. The BOG compressor discharge is between about −110° C. to −125° C. in normal operation.

During open mode operation, the quench system was designed for a 60 T/hr load at −80° C. Under these conditions, the maximum BOG return gas temperature was −145° C. at 60 T/hr at the BOG compressor suction. The time required to heat a tank from −160 to +5° C. was estimated to be less than 24 hours including the time to evaporate 1 meter of residual LNG in a single 2500 $m^3$ tank. The heating was done simultaneously with a separate single operating tank with a BOG return rate of 4.3 T/hr. This heating process is required prior to a 20 hour cycle that brings inert gas followed by air. After this time, it is expected that most of the bottom 1 meter of liquid in the storage tank will have been vaporized and the vaporized gas is recirculated from the connection at the compressor suction and excess gas is sent to the flare as needed.

During closed mode operation, the heating process is required prior to the 20 hour cycle to bring in inert gas followed by air. The amount of gas available initially and recirculated is gradually increased until the maximum rate that the BOG compressor can handle is reached. After this time, it is expected that most of the bottom 1 meter of liquid in the tank will have been vaporized and the gas is recirculated from the connection at the BOG compressor suction and excess gas is sent to the flare. A split range pressure control connection allows the gas to be routed to the flare. A bypass is provided to allow temperature control of the warmed methane so that the potential for thermal shock is minimized (on temperature control). Hot water rate is maintained at a continuous rate. In some embodiments, an electric heater with temperature control and no bypass may be used.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method for vaporizing liquefied natural gas (LNG) produced from a main liquefaction process and stored in an LNG storage tank comprising:

a) heating via a warm predominantly methane stream at least a portion of the LNG to provide a boil-off gas stream and a liquid quench stream;

b) routing the boil-off gas stream and the liquid quench stream to a quench system, wherein the quench system cools the boil-off gas stream to provide a quenched stream;

c) compressing the quenched stream to provide a compressed quenched stream, wherein a first part of the compressed quenched stream is routed to the main liquefaction process; and d) heating a second part of the compressed quenched stream to provide a warm compressed quenched stream wherein the warm compressed quenched stream is the warm predominantly methane stream used to heat the LNG; wherein the warm predominantly methane stream is used as a refrigerant in a refrigeration cycle of the main liquefaction process.

2. The method of claim 1 wherein the first part of the compressed quenched stream is routed to a low-stage methane compressor of the main liquefaction process.

3. The method of claim 1 wherein the quench system is a compressor suction drum.

4. The method of claim 1 further comprising: routing boil-off gas originating from an LNG carrier to the quench system.

* * * * *